United States Patent [19]

Toyoda

[11] Patent Number: 4,955,347

[45] Date of Patent: Sep. 11, 1990

[54] FUEL INJECTOR ASSEMBLY FOR FUEL-INJECTED ENGINE

[75] Inventor: Yasuhiro Toyoda, Saitama, Japan

[73] Assignee: Honda Giken Kogyo Kabushiki Kaisha, Tokyo, Japan

[21] Appl. No.: 337,012

[22] Filed: Apr. 12, 1989

[30] Foreign Application Priority Data

Apr. 12, 1988 [JP] Japan ..... 63-89726

[51] Int. Cl.[5] ..... F02M 39/00

[52] U.S. Cl. ..... 123/472; 123/531; 123/432; 123/470

[58] Field of Search ..... 123/472, 470, 471, 531, 123/432

[56] References Cited

U.S. PATENT DOCUMENTS

| | | | |
|---|---|---|---|
| 4,149,496 | 4/1979 | Palma | 123/472 |
| 4,347,823 | 9/1982 | Kessler | 123/472 |
| 4,465,050 | 8/1984 | Igashira | 123/472 |
| 4,508,091 | 4/1985 | Wakeman | 123/472 |
| 4,512,311 | 4/1985 | Sugiyama | 123/432 |
| 4,708,117 | 11/1987 | Mesenich | 123/531 |
| 4,817,570 | 4/1989 | Morita | 123/472 |

FOREIGN PATENT DOCUMENTS

| | | |
|---|---|---|
| 2412490 | 9/1975 | Fed. Rep. of Germany . |
| 61-116066 | 6/1986 | Japan . |

OTHER PUBLICATIONS

English summary of Japanese Publication 60-32957, Feb. 1985.

*Primary Examiner*—Carl Stuart Miller
*Attorney, Agent, or Firm*—Lyon & Lyon

[57] ABSTRACT

A fuel injector assembly in an engine having a plurality of cylinders and intake passages opening respectively into the cylinders includes a housing mounted in each of the intake passages, and a plurality of solenoid-operated fuel injection valves connected to a fuel supply source for injecting fuel through the intake passage into each of the cylinders. The solenoid-operated fuel injection valves are accommodated in the housing. The housing has a magnetic shield layer such as an air gap disposed between the fuel injection valve means. The fuel injection valves are supplied with fuel from the fuel supply source through a common fuel supply passage defined in the housing.

3 Claims, 3 Drawing Sheets

FUEL INJECTOR ASSEMBLY FOR FUEL-INJECTED ENGINE

BACKGROUND OF THE INVENTION

The present invention relates to a fuel injector assembly for a fuel-injected engine, which has a plurality of intake passages opening into each combustion chamber having respective fuel injection valves disposed therein, and more particularly to a fuel injector assembly in which fuel injection valves are assembled together with a magnetic shield layer therebetween.

Some recent high-performance engines have two intake passages independently opening into each combustion chamber and associated with respective fuel injection valves for increased charging efficiency and independent fuel control required by the intake passages. One known fuel injection assembly for use with such a fuel-injected engine is disclosed in Japanese Laid-Open Patent Publication No. 60-32957. In the disclosed arrangement, the intake passages have respective solenoid-operated fuel injection valves disposed therein. One of the intake passages is opened and closed dependent on the rotational speed of the engine or the load on the engine, and at the same time the fuel injection valve disposed in said one intake passage is controlled in timed relation to the opening and closing of the intake passage for improved engine performance, such as greater engine output torque.

Since the fuel injection valves are disposed respectively in the intake passages, however, a cylinder head or an intake manifold in which the intake passages are defined must have delivery passages defined therein for distributing fuel to the respective fuel injection valves. Therefore, the cylinder head is complex in configuration, high in cost, and has to be assembled through an increased number of steps.

SUMMARY OF THE INVENTION

In view of the aforesaid drawbacks of the conventional fuel injector arrangement, it is an object of the present invention to provide a fuel injector assembly which can be manufactured at a low cost and assembled through a small number of steps.

According to the present invention, there is provide a fuel injector assembly in an engine having a plurality of cylinders and intake passages opening respectively into the cylinders, comprising a housing mounted in each of the intake passages, and a plurality of solenoid-operated fuel injection valve means connected to a fuel supply source for injecting fuel through the intake passage into each of the cylinders, the plurality of solenoid-operated fuel injection valve means being accommodated in the housing, the housing having a magnetic shield layer disposed between the fuel injection valve means.

All the solenoid-operated fuel injection valve means associated with each cylinder are assembled in the single housing and placed in the corresponding intake passage. Since fuel can be supplied through a common fuel supply passage to the fuel injection valve means associated with each cylinder the cost of manufacture of the fuel injector assembly is reduced, and the fuel injection valve means can easily be installed in place. Because the magnetic shield layer is disposed between the fuel injection valve means, even when solenoids of the fuel injection valve means are selectively energized, they are not subjected to magnetic interference and can reliably be operated.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

Figure 1:
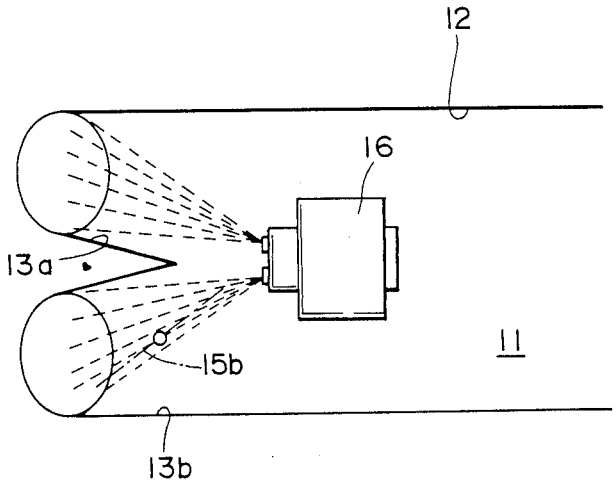
FIG. 1 is a schematic plan view of a fuel injector assembly for a fuel-injected engine according to an embodiment of the present invention.
Figure 2:
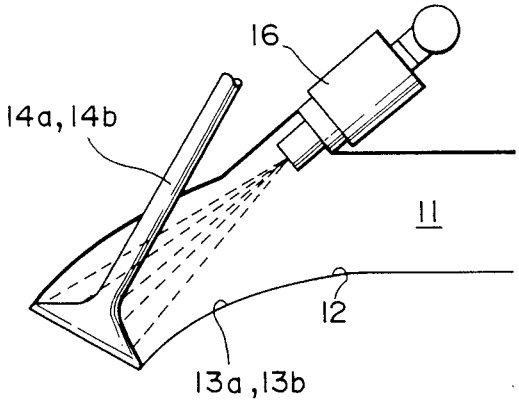
FIG. 2 is a schematic side elevational view of the fuel injector assembly shown in FIG. 1.
Figure 3:
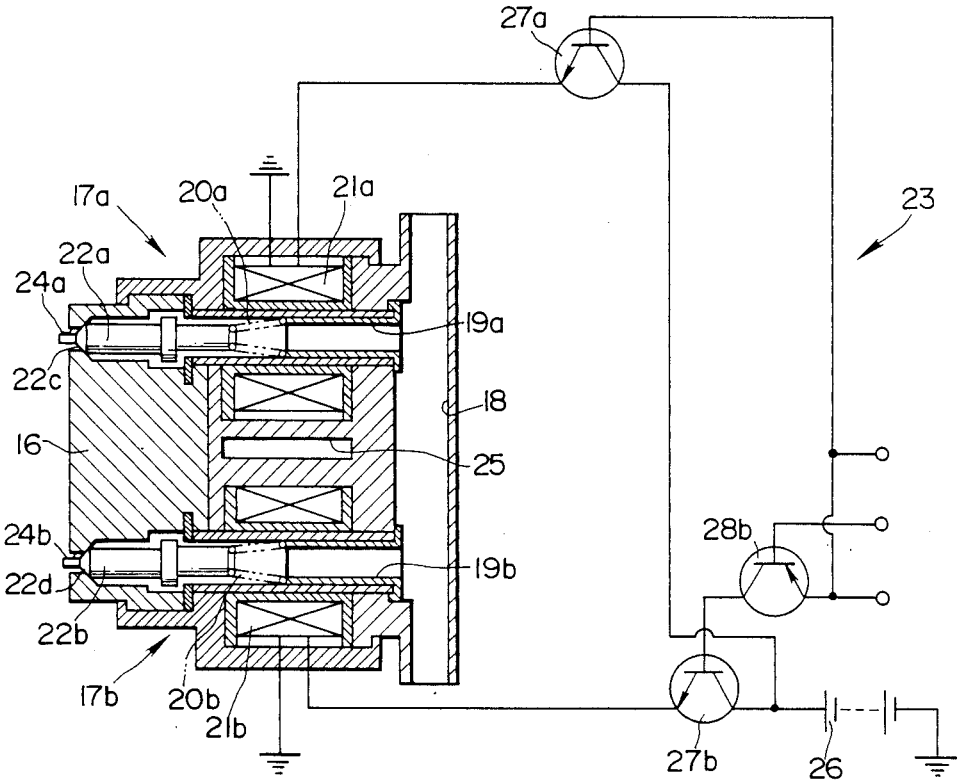
FIG. 3 is an enlarged cross-sectional view of a fuel injector valve in the fuel injector assembly.

FIGS. 1 through 3 show a fuel injector assembly according to an embodiment of the present invention. An intake passage 11 for introducing air is defined in the intake manifold or cylinder head of an engine (not shown) and has an inlet passage 12 and a pair of first and second branch passages 13*a*, 13*b* branched from the inlet passage 12 and opening into a combustion chamber (not shown) in an engine cylinder. The first and second branch passages 13*a*, 13*b* house therein respective intake valves 14*a*, 14*b* for selectively opening and closing intake ports of the first and second branch passages 13*a*, 13*b*. A shutter valve 15*b* is disposed in the first branch passage 13*b* for selectively opening and closing the first branch passage 13*b*. The intake valves 14*a*, 14*b* are openable and closable in synchronism with rotation of the crankshaft (not shown) of the engine through a known valve operating mechanism. The shutter valve 15*a* is openable and closable by an actuator (not shown) dependent on operating conditions of the engine in the manner disclosed in Japanese Laid-Open Patent Publication No. 60-32957 or 59-43922, for example. The inlet passage 12, or the upstream end of the intake passage 11, is connected to an air cleaner or the like for drawing in air. The intake passage 11 is provided in combination with one combustion chamber Therefore, a four-cylinder engine has four intake passages 11 coupled respectively to the four combustion chambers.

Two fuel injection valves 17*a*, 17*b* which are encased in a single housing 16 are disposed in the intake passage 11 just upstream of the point where the inlet passage 12 is branched into the first and second branch passages 13*a*, 13*b*. As shown in FIG. 3, the housing 16 is fixed to a wall defining the intake passage 11 and has defined therein a fuel supply hole 18 and two housing holes 19*a*, 19*b* extending perpendicularly to the fuel supply hole 18. The fuel supply hole 18 is connected through a pipe or the like to the fuel injector assembly associated with an adjacent engine cylinder, and is coupled to a fuel pump (not shown). The housing holes 19*a*, 19*b* have ends directed toward the substantial centers of the branch passages 13*a*, 13*b* and opposite ends opening into the fuel supply hole 18. The housing holes 19*a*, 19*b* accommodate therein the respective fuel injection valves 17*a*, 17*b* which comprise springs 20*a*, 20*b*, solenoids 21*a*, 21*b*, and needle valves 22*a*, 22*b*. The solenoids 21*a*, 21*b* are annularly fixedly positioned centrally in the respectively housing holes 19*a*, 19*b* and electrically connected to a driver circuit 23 (described later). The needle valves 22*a*, 22*b* have needles on their ends which are loosely fitted respectively in the end openings of the housing holes 19*a*, 19*b*, thus defining fuel injection nozzles 24*a*, 24*b*. The needle valves 22*a*, 22*b* also have respective tapered seats 22*c*, 22*d* near the needles and engageable with corresponding seats around the end openings of the housing holes 19*a*, 19*b* for closing the fuel injection valves 24*a*, 24*b*. The needle valves 22*a*, 22*b* are axially movably disposed in the housing holes 19*a*, 19*b*, respectively, and extend through the respective solenoids 21*a*, 21*b*. When the solenoids 21*a*, 21*b* are energized, the needle valves 22*a*, 22*b* are axially displaced to close the fuel injection valves 24*a*, 24*b*. The springs 20*a*, 20*b* act on the respective needle valves 22*a*, 22*b* for normally urging them in a direction to close the fuel injection nozzles 24*a*, 24*b*.

The housing 16 has a vacant hole or air gap 25 having a rectangular cross section defined therein between the housing holes 19*a*, 19*b*, the vacant hole 25 serving as a magnetic shield air layer The vacant hole 25 lies between the solenoids 21*a*, 21*b* and extend fully across the solenoids 21*a*; 21*b* to provide a shield against magnetic fluxes produced by the solenoids 21*a*, 21*b*. The vacant hole 25 is filled with air, but may be filled with a substance having a low magnetic permeability.

The driver circuit 23 comprises a battery 26, a switching power transistor 27*a* connected between the battery 26 and the solenoid 21*a*, a power transistor 27*b* connected between the battery 26 and the solenoid 21*b*, and a transistor 28*b* for controlling the power transistor 27*b*. The power transistor 27*b* has an emitter connected to the solenoid 21*b*, a collector to the battery 26, and a base to the collector of the transistor 28*b*. The power transistor 27*a* has an emitter connected to the solenoid 21*a*, a collector to the battery 26, and a base to a control circuit (not shown) to which the emitter and base of the transistor 28*b* are also coupled.

Dependent on operating conditions of the engine, the control circuit produces a control signal to selectively turn on the power transistors 27*a*, 27*b* for selectively energizing the solenoids 21*a*, 21*b* of the fuel injection valves 17*a*, 17*b* to inject fuel. When the engine rotates at a high speed, for example, the solenoids 21*a*, 21*b* of both of the fuel injection valves 17*a*, 17*b* are energized to enable the fuel injection valves 17*a*, 17*b* to inject fuel from the nozzles 24*a*, 24*b* into the branch passages 13*a*, 13*b*.

When the engine rotates at a low speed, only the solenoid 21*a* of the fuel injection valve 17*a* is energized to inject fuel into the branch passage 13*a*, whereas the other branch passage 13*b* is closed by the shutter valve 15*b*. At this time, since the vacant hole 25 between the solenoids 21*a*, 21*b* shields the solenoid 21*b* from the magnetic flux produced by the solenoid 21*a*, the fuel injection valve 17*b* is not triggered into operation by the energization of the solenoid 21*a*.

Since the two fuel injection valves 17*a*, 17*b* are assembled in the single housing 16, the fuel injector assembly can easily be installed in place, does not make the cylinder head or intake manifold complex in configuration, and can be manufactured at a low cost. It is not necessary to connect fuel supply pipes respectively to the fuel injection valves 17*a*, 17*b* because the fuel injection valves 17*a*, 17*b* share the fuel supply hole 18 defined in the housing 16. The cylinder head or intake manifold is therefore simple in construction and highly reliable in operation as there is no danger of fuel leakage which would otherwise be caused from separate fuel supply pipes.

Figure 4:
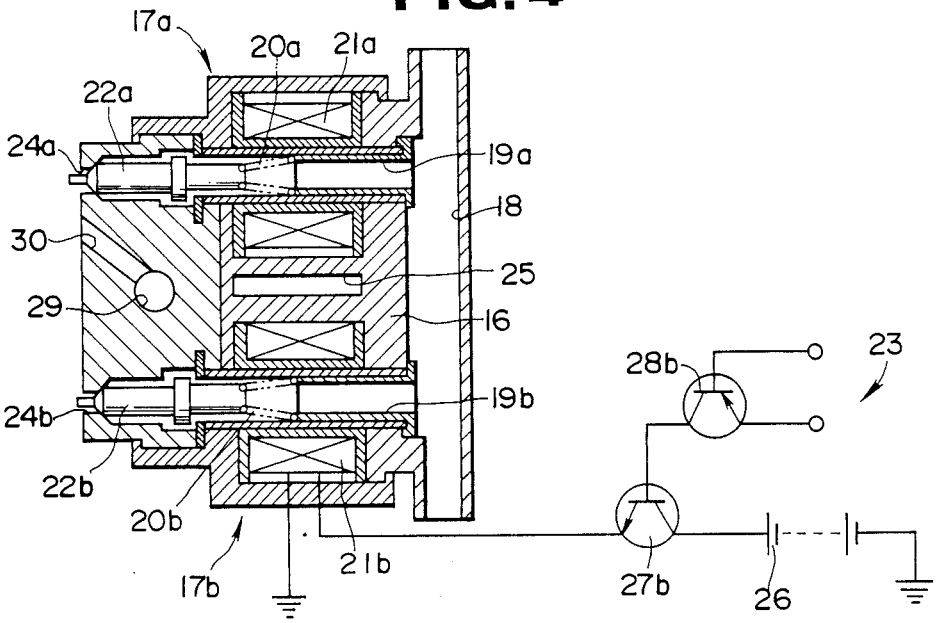
FIG. 4 is an enlarged cross-sectional view of a fuel injector valve according to another embodiment of the present invention.
Figure 5:
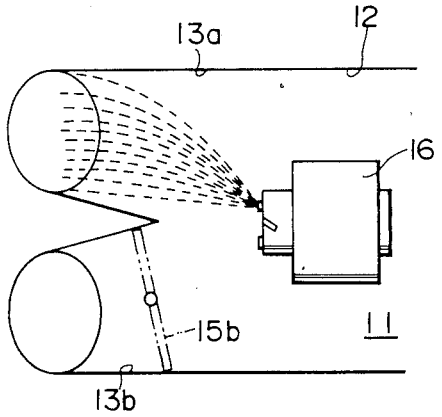
FIG. 5 is a schematic plan view of a fuel injector assembly incorporating the fuel injector valve shown in FIG. 4.

FIGS. 4 and 5 show a fuel injector assembly according to another embodiment of the present invention. Those parts shown in FIGS. 4 and 5 which are identical to those in FIGS. 1 through 3 are denoted by identical reference numerals.

According to the embodiment of FIGS. 4 and 5, a housing 16 additionally defines therein an auxiliary air passage 29 connected to a region upstream of a throttle valve (not shown), and an auxiliary air injection hole 30 extending from the auxiliary air passage 29 and opening toward one of the branch passages 13*a*. A driver circuit 23 energizes the solenoid 21*a* of the fuel injection valve 17*a* at all times, and energizes the solenoid 21*b* of the fuel injection valve 17*b* with the transistor 28*b* and the power transistor 27*b* based on a control signal from the control circuit.

With this embodiment, when fuel is injected only from the fuel injection valve 17*a*, auxiliary air is injected from the air injection hole 30 toward the spray of fuel injected from the fuel injection valve 17*a* for promoting the atomization of the fuel for better fuel combustion efficiency.

Although there have been described what are at present considered to be the preferred embodiments of the present invention, it will be understood that the invention may be embodied in other specific forms without departing from the essential characteristics thereof. The present embodiments are therefore to be considered in all aspects as illustrative, and not restrictive. The scope of the invention is indicated by the appended claims rather than by the foregoing description.

I claim:

1. A fuel injection assembly in an engine having a plurality of cylinders and intake passages opening respectively to the cylinders, comprising:

a single injection body mounted in each of said intake passages;

a pair of solenoid-operated fuel injection valve means connected to a fuel supply source for injecting fuel through the intake passage into each of the cylinders; and said pair of solenoid-operated fuel injection valve means being accommodated in said injection body and each having a hole defined in said injection body, a needle valve axially movably disposed in said hole, and a solenoid for axially moving said needle valve in said hole, said single injection body having a magnetic shield layer between said fuel injection valve means, said magnetic shield layer having a width not less than the width of said solenoids.

2. A fuel injection assembly according to claim 1, wherein each of said intake passages comprises an inlet passage and first and second branch passages branched from said inlet passage, further including a shutter valve for opening and closing one of said first and second branch passages.

3. A fuel injector assembly according to claim 1, wherein said housing has defined therein an air inlet passage connected to an air supply source and an air injection hole connected to said air inlet passage for injecting air supplied from said air supply source toward a spray of fuel injected from one of said fuel injection valve means.

* * * * *